United States Patent [19]

Nathaniel

[11] 4,030,729

[45] June 21, 1977

[54] ICE SKATING SURFACE

[76] Inventor: Elmer O. Nathaniel, 9178 Villaridge, St. Louis, Mo. 63123

[22] Filed: July 23, 1975

[21] Appl. No.: 598,362

[52] U.S. Cl. ..... 272/3; 404/41

[51] Int. Cl.[2] ..... A63J 3/00

[58] Field of Search ..... 404/41, 44, 35, 17, 404/18, 34; 272/3; 52/590, 392

[56] References Cited

UNITED STATES PATENTS

| | | | |
|---|---|---|---|
| 654,532 | 7/1900 | Furness | 52/590 X |
| 708,471 | 9/1902 | Flood | 404/41 X |
| 1,430,392 | 9/1922 | Lukens | 404/41 X |
| 2,368,330 | 1/1945 | Schwartz | 404/41 |
| 2,999,431 | 9/1961 | Mitchell | 52/392 X |
| 3,497,211 | 2/1970 | Nagin | 404/44 X |
| 3,552,746 | 1/1971 | Nagin | 404/34 X |

*Primary Examiner*—Nile C. Byers
*Attorney, Agent, or Firm*—Ralph W. Kalish

[57] ABSTRACT

An ice skating surface of artificial or non-refrigerated character which is constituted of a multiplicity of discrete panel-like components each of which are preferably of identical construction for ease of assembly and replacement. Each component is desirably of square form being fabricated of moldable material and having a thickness in the range of ¼ inch to ½ inch. Each component is provided along its edges with alternating tongues and cavities of complementary contour for interlocking relationship with the corresponding elements on the confronting edge of adjacent components so as to form an integrated surface wherein accidental parting of the components is reliably inhibited.

4 Claims, 2 Drawing Figures

ICE SKATING SURFACE

BACKGROUND AND SUMMARY OF THE INVENTION

This invention relates in general to artificial ice skating surfaces and, more particularly, to a surface comprised of a multiplicity of interlockable components.

Heretofore various efforts have been made to develop artificial or non-refrigerated skating surfaces. One such attempt is disclosed in the Haemer et al U.S. Pat. No. 3,508,945 wherein the surface is constituted of a single sheet of polymeric material which is cemented to a backing board. Another effort is revealed in the Nagin U.S. Pat. No. 3,497,211 wherein the skating surface is constituted of plastic slabs or panels of uniform size, being of rectangular form and having linear edges for reception within a concrete curb, which serves as a frame for retaining the panels against relative displacement, the edges thereof being in mutual abutting relation. The Nagin Patent also shows another form wherein the panels are mounted upon a plywood base with anchoring means projecting from such base to secure the panels thereto. It will thus be seen that the prior art teachings do not permit of ease of expansion or contraction of the skating surface after the same has been placed in use since in each instance the particular dimensions must be very carefully established in advance for the sheet or frame as the case may be, and the components formed in accordance to the particular requirements.

Therefore, it is an object of the present invention to provide a skating surface of non-refrigerated or artificial character which is composed of an optional number of integrated components which are adapted for mutual, inlerlocking relationship.

It is another object of the present invention to provide a skating surface of the character stated wherein the integrated components are self-contained and do not require backing members or delimiting, retaining curbs or frames.

It is a still further object of the present invention to provide a skating surface of the character stated wherein each component is of identical configuration thereby conducing to rapid, high volume, economical production, as well as facilitating assembly into surface formation; and which allows of ready component replacement.

It is another object of the present invention to provide a skating surface of the character stated which does not necessitate a preformed foundation, and which surface by virtue of the novel configuration of the individual components may be expanded for extension over any available flat area or contracted for accommodating any relatively reduced area.

It is a further object of the present invention to provide a skating surface of the type stated comprising integrable components of identical construction which are durable in usage; which components are of such size and weight as to be easily handled for transportability, as well as assembly and disassembly without necessitating the use of skilled personnel.

It is a still further object of the present invention to provide a skating surface of the character stated wherein the components are not secured to the support surface; wherein each component may be, if necessary, easily removed for replacement and wherein in view of areas of relative wear can be reversed or removed to other zones of the surface; and wherein the interconnection prevents interference with the user's skates.

DESCRIPTION OF THE PREFERRED EMBODIMENT

Figure 1:
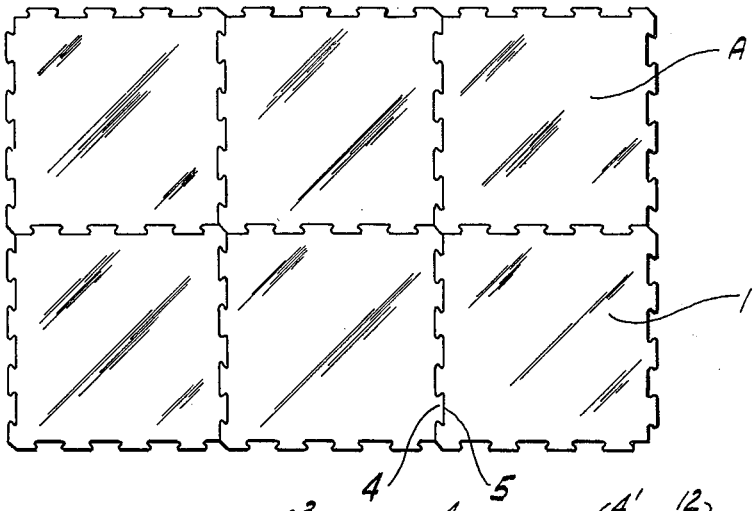
FIG. 1 is a plan view of an ice skating surface comprised of a multiplicity of components constructed in accordance with, and embodying the present invention.

Referring now by reference numerals to the drawing which illustrates the preferred embodiment of the present invention, A designates an artificial skating surface comprising of a multiplicity of discrete components 1, each being of identical character, having like contour, size, and thickness, and being of flat, panel-like form. The material of construction of choice for each component 1 is high density polyethylene, polypropylene, and fluorinated polyethylene, with the same being developed from extruded sheets of such material from which the components may be machined to the below described configuration by utilization of a template. Each component 1 is of four-sided character, being preferably square, so that assemblage is facilitated by eliminating the problem of orientation. It is obviously within the scope of this invention to cause the said components to be of rectangular or even triangular form, although understandably such contours do not lend themselves to as ready and simple a skating surface as does a square configuration.

The dimensions of components 1 may be of any preselected extent, although dimensions of 1 foot × 1 foot, or 2 feet × 2 feet, if desired as units of such area are easily handled and allow for more ready effective accommodation to the particular zone of use. The thickness of components 1 also may have some relative range, although in practice a thickness of ¼ inch has been found to be fully satisfactory. Any further thickness would tend to increase cost of production beyond any additional benefits to be obtained thereby.

Figure 2:
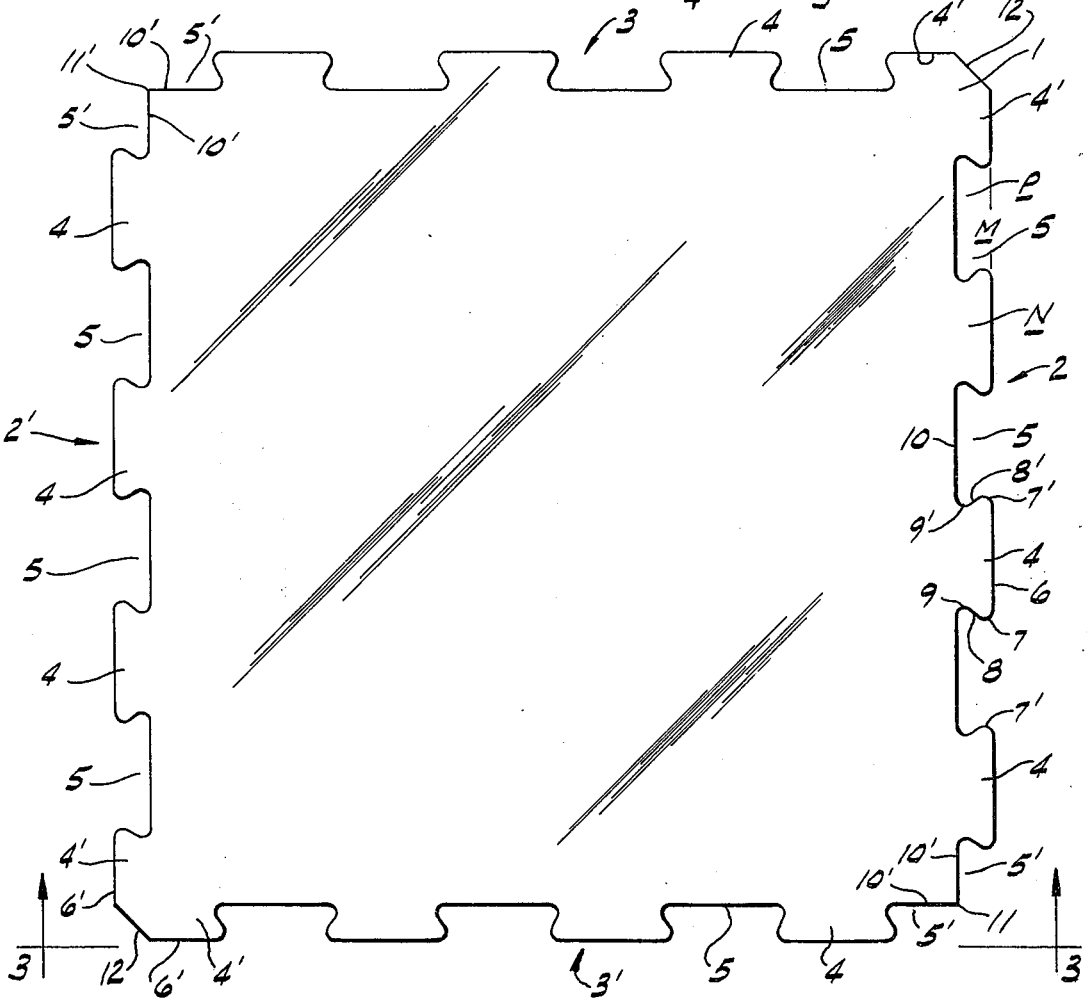
FIG. 2 is an enlarged plan view of a surface component.
Figure 3:
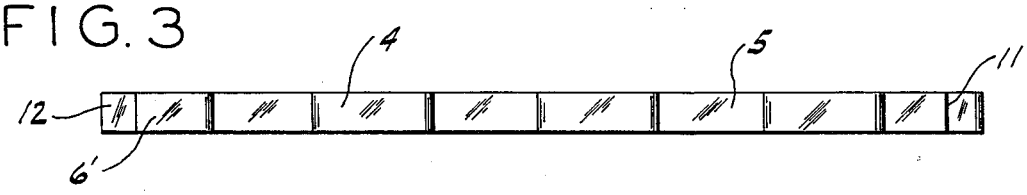
FIG. 3 is an elevational view taken on the line 3—3 of FIG. 2.

Referring now to FIG. 2 for purposes of description, component 1 contains two pair of parallel side edges, as at 2,2', and 3,3'. Each of said side edges 2,2', 3,3' between their end portions are of like configurations to the extent of providing a like number of tongues, projections, or tenons 4 and recesses, cavities, or mortises 5 in alternation therewith. It is apparent that the number of projections 4 and recesses 5 is the same for each side and may be of any predetermined number although for purposes of illustration, three such tongues 4 with intervening complementary formed recesses 5 are shown in the drawings. Each tongue 4 is provided with a linear outer edge, as at 6, which is axially parallel to the axis of component 1 corresponding to the related side and with the ends of each such linear edge being arcuated, as at 7,7' for continuity with an inwardly tapering or receding edge portion 8,8' which latter merges into a concave or arcuate portion 9,9', respectively, in reverse relationship to the adjacent arcuate portions 7,7', respectively. At their inner ends arcuate portions 9,9' are continuous with a linear section 10 which constitutes the base of the adjacent recess 5 and which is axially parallel to the outer linear edges 6 of tongues 4. It will thus be seen that the side edge portions of each tongue 4 also concurrently constitute the sides of the adjacent recess 5.

From the foregoing it will thus be seen that tongues 4 and recesses 5 are of complementary configuration whereby each recess 5 will comprehend a relatively constricted mouth *m* defined by the opposed arcuate edges 7,7′ of the two proximate tongues 4 which mouth *m* communicates with a relatively extended interior portion *p*.

It will be further observed that the tongues 4 along one side of a component 1 are snugly and lockingly receivable within the aligned recess 5 on the confronting edge of the next adjacent component 1, as may best be seen in FIG. 1. However, it is apparent that tongues 4 and recesses 5 along one side of each component 1 are in off-setting or alternating relationship to the corresponding tongues 4 and recesses 5 on the opposed parallel side of such component 1. With reference to FIG. 2 it will thereby be seen that the tongues 4 on side 2 are in opposed relationship to the recesses 5 on side 2′ of said component 1. Tongues 4 and recesses 5 on sides 3,3′ are in similar relationship. Understandably, since component 1 is set forth as being of square form, the parallel pairs of sides 2,2′ and 3,3′ are necessarily of like mutual relationship.

At opposite, or diagonally related, end portions of sides 2,2′ and similarly at opposite, or diagonally related, end portions of sides 3,3′, the immediately proximate tongue 4 is spaced from the adjacent side end extremity so that only a partial recess, as at 5′, is provided which is thus what might be considered open-sided toward such end and embodies a reduced base 10′ forming a right angle with base 10′ of the partial recess 5′ along the adjacent component side thereby developing right angle corners at 11,11′ between sides 2,3′ and sides 2′, 3 which corners are on a diagonal line. At the other end portions, that is, from adjacent corners 11,11′, each side 2,2′, 3,3′ is provided with a partial tongue 4′ having outer linear edges 6′ which are of reduced length relative to the outer edges 6 of tongues 4 and at their outer ends are continuous with a miter or bevel edge 12 which serves to connect the linear edges 6′ of the tongues 4′ of sides 2′,3′ and of sides 2,3 to define the remaining corner sections of component 1, which bevel edges 12 are diagonally related.

At the risk of repetition, it will thus be seen that as viewed elevationally the configuration of sides 2,2′ are the same, while similarly sides 3,3′ are the same, but with sides 3,3′ being thus opposite to sides 2,2′ by reason of the corner arrangements.

With reference now being made to FIG. 1, the development of skating surface A from a multiplicity of components 1 should be evident. Thus, side 2 of one component is interengaged with side 2′ of the next component for linear growth of the developing surface A. For what might be considered lateral growth, sides 3′ of components 1 are engaged to sides 3 of the next component and thereby bring about growth in a direction perpendicular to that developed through mere interengagement of sides 2 and 2′. The novel configuration of tongues 4 and recesses 5 bring about a reliable interlock of components 1 so that inadvertent or accidental disengagement is inhibited during usage. The enlarged or outer portions of tongues 5 are accepted within the interior portions *p* of the engaged recess 5 and by virtue of the relative narrowness of mouths *m* of recesses 5 and the corresponding width of the base portions or necks, as at *n*, of tongues 4, disengagement is inhibited under tension or forces of expansion. The corner configurations of components 1 are most novel as bevel edges 12 of one component will abut against a similar edge of the diagonally related component 1 (see FIG. 1) and the bases 10′ of corners 11,11′ will abut the confronting edge 6′ of the adjacent components 1 so that snug interfit is assured.

Therefore, regardless of the requirements of use and the conditions to which skating surface A may be subjected during usage said components 1 will assure of mutual retention in proper surface formation. It is evident that components 1 may be readily interfitted without the utilization of specialized tools and without the services of skilled individuals. Furthermore, the assembly and disassembly of components 1 into skating surface A may be quickly effected and components 1, as indicated, may be of such size for facile handling for ease of storage and transportability.

Skating surface A may be disposed upon any flat surface for effective usage and does not necessitate pretreatment of such surface as by providing a backing, slab, or other foundation-like element.

After surface A has been formed, a lubricant is applied to the upper face thereof for rendering same skatable in a manner which is scarcely distinguishable from that provided by a refrigerated surface. Lubricants particularly suitable for use with the present invention are set forth and described in copending application Ser. No. 508,985.

Surfaces constructed in accordance with components of the present invention thus provide an opportunity for individuals to skate anywhere indoors as long as the surface is of requisite flatness. Thus, the present invention eliminates the need for costly ice skating rinks which have heretofore been found primarily in highly urbanized areas only.

It is to be appreciated that components 1 are in no way fastened to the support surface and each component may, if necessary, be lifted from its position and either rotated at 180°, if desired; or replaced. Thus, the entire skating surface is in no way disturbed by replacement of individual components 1. Furthermore, the components 1 can be removed to other areas to the surface A in the event certain areas of wear thereon may make it less desirable in its initial position. Thus, by being removed to marginal or border zones, where there is less wear, such components' life may be extended. Furthermore, in the event of such wear, each component 1 can be turned upside-down so that its erstwhile under face may be presented for use. Skating surface A is of exceeding inherent versatility for longevity and economy in usage.

It is furthermore to be observed that the prior art, as discussed above, reveals only slabs or panels having straight edges so that there is the danger that a skater's skate may be caught between adjacent panels with the possibility of severe injury to the ankle or leg. By reason of the novel edge configuration of components 1, there is no possibility of catching a skater's skate as the interlock prevents separation of the components and thereby assures of safety which has not been provided by structures heretofore known.

Having described my invention, what I claim and desire to obtain by Letters Patent is:

1. A discrete component for development of artificial surfaces for ice skating-simulative purposes comprising a flat planar body formed of resinous material from the class consisting of high density polyethylene, polypropylene, and fluorinated polyethylene, said body being of quadrilateral configuration having first and second pairs of opposed sides, each of said sides of each pair having alternating projections and recesses disposed in a plane normal to the surface of said body, the recesses on one side being transversely aligned with the projections on the companion opposed side, said recesses having rectilinear bases, the bases of the recesses on each side being aligned, and said body having first and second sets of diagonally related corner portions, one set of diagonally related corners comprising meeting portions of the bases of recesses provided at the ends of the adjacent component sides, said meeting base portions being perpendicular to each other to form a right angle corner, the other set of diagonally related corners comprising the portions of projections provided at the ends of the adjacent component sides which projection portions merge to form an integrated corner element in the extreme corner portion of each corner element there being a bevel portion which is axially parallel with the corresponding bevel portion of the diagonally related corner, each such bevel being coplanar with the recesses and projections and hence planarwise perpendicular to the surface of said body.

2. A discrete component as defined in claim 1 and further characterized by said alternating projections and recesses being of complementary configuration.

3. A discrete component as defined in claim 1 and further characterized by said beveled corner portions being at an angle of substantially 45° to the adjacent sides of said component.

4. An artificial ice skatig surface comprising a plurality of flat planar components formed of resinous material from the class consisting of high density polyethylene, polypropylene, and fluorinated polyethylene, each of said components being of quadrilateral configuration having first and second pairs of opposed sides, each of said sides being provided with alternating projections and recesses disposed in a plane normal to the flat planar surface of the related component, the recesses on one side being transversely aligned with the projections on the opposed side for interlockable engagement with projections on the confronting side of an adjacent component for integrating said components into the aforesaid surface, said recesses on each side of each component being rectilinear and having the bases of the recesses on each side being aligned each of said components having first and second sets of diagonally related corner portions, one set of diagonally related corners comprising meeting portions of the bases of recesses provided at the ends of the adjacent component sides, said meeting recess base portions being perpendicular to each other to form a right angular corner, the other set of diagonally related corners comprising portions of projections provided at the ends of the adjacent component sides which portions merge to form an integrated corner element each such corner element in the zone of merger having a bevel edge coplanar with the bases of said recesses and projections whereby said bevel edges are planarwise perpendicular with the flat plane of the related components, whereby the bevel edge at one corner of a component is presented in continuity with the meeting point of the right angular corner of an adjacent component so as to be presented for abutment against the like bevel edge of a third component during integration of said components to form said surface.

* * * * *